United States Patent [19]

Carmon, Jr.

[11] Patent Number: 4,826,038

[45] **Date of Patent: * May 2, 1989**

[54] PLATING BARREL DOOR APPARATUS

[75] Inventor: Lawrence J. Carmon, Jr., Rocky River, Ohio

[73] Assignee: Singleton Corporation, Cleveland, Ohio

[ * ] Notice: The portion of the term of this patent subsequent to Apr. 12, 2005 has been disclaimed.

[21] Appl. No.: 136,105

[22] Filed: Dec. 21, 1987

Related U.S. Application Data

[63] Continuation of Ser. No. 877,808, Jun. 24, 1986, Pat. No. 4,736,868.

[51] Int. Cl.[4] ..... B65D 43/20

[52] U.S. Cl. ..... 220/345

[58] Field of Search ..... 220/345

[56] References Cited

U.S. PATENT DOCUMENTS 3,356,248 12/1967 Vecchio ..... 220/345
3,861,654 1/1975 Singleton .
4,154,538 5/1979 Linnhoff et al. ..... 366/188
4,422,774 12/1983 Little .
4,467,940 8/1984 Little .

*Primary Examiner*—George T. Hall
*Attorney, Agent, or Firm*—Fay, Sharpe, Beall, Fagan, Minnich & McKee

[57] ABSTRACT

A rotatable container assembly for use in surface treatment of particulate workpieces includes a container having opposed head ends and a side member defining a work cavity therein. An aperture is formed in a minor portion of the side member and a door arranged for opening and closing relation with the aperture. Means for imparting generally arcuate movement and generally radial movement advances and retracts the door between open and closed positions. Preferably, the movement imparting means includes a cam slot and cam follower arranged between a driven gear and a closely adjacent end plate. Push blocks assist in selective rotation of the container both relative to and with the door. Plural locking slots are arranged on the periphery of the end plate for operative engagement with a lock member extending from the gear.

1 Claim, 5 Drawing Sheets

PLATING BARREL DOOR APPARATUS

This application is a continuation of application Ser. No. 877,808, filed 6-24-86, now U.S. Pat. No. 4,736,868.

BACKGROUND OF THE INVENTION

The present invention pertains to apparatus for treating articles of manufacture in a fluid. More particularly, the invention relates to doors and closures for treatment containers or barrels which are adapted to be disposed in a tank of treating fluid.

The invention finds particular application in the art of electroplating and will be described with particular reference thereto. However, it is to be appreciated that the invention is also applicable for cleaning, phosphating, rinsing and other treating operations.

A conventional plating barrel is filled with particulate workpieces or items to be plated or treated and immersed in an electroplating or other highly corrosive treating fluid. The barrel is rotated within a tank of treating fluid whereby the treated items cascade over each other in the interior of the barrel. The barrel interior is typically filled approximately one-third to one-half its capacity and generally holds workpieces collectively weighing over one hundred pounds and, on certain occasions, holding workpieces collectively weighing as much as five hundred pounds or more. The barrels must be sufficiently durable and are constructed of a material adapted to withstand the usually corrosive effects of the treating fluid. Selected plastics have been used with commerical success.

The barrel has a generally circular sidewall and a pair of opposed flat head ends or endwalls defining a work cavity therein. Oftentimes, the cylindrically shaped barrel is formed of a plurality of panel members arranged in a hexagonal or octogonal relationship and weldingly secured to the heads. One of the panels is left out of the welded arrangement and adapted or modified for selective removal and thereby function as a door. The removable panel provides ingress and egress to the interior work cavity. Due to the extreme weight and various workpiece sizes subject to the treating process, a secure and close fitting arrangement is required between the door and the remainder of the barrel. The enclosure mechanism which holds the door closed must be sufficiently strong to withstand the weight of the cascading workpieces contained therein, sufficiently corrosion resistant to withstand the treating fluids, and easy to operate.

By way of example, U.S. Pat. No. 2,886,505, issued May 12, 1959 to Singleton, et al. illustrates a conventional clamping arrangement for holding a door in a closed position. As is evident, the door is substantially similar to the remaining panels defining the sidewall of the generally cylindrical container. Still other clamping arrangements are illustrated in U.S. Pat. No. 912,041 to Snow and U.S. Pat. No. 2,843,979 to Lupo. Both of these patents require direct operator assistance in fastening and clamping the door in fixed, covering relation with the aperture and the remainder of the barrel. U.S. Pat. Nos. 3,507,529 and 3,583,739 issued Apr. 21, 1970 and June 8, 1971, respectively, to Gill are both directed to a door assembly for a plating barrel. Although applicable to use of automated machinery in lifting the door from the barrel, these arrangements necessarily require manual operator assistance to unfasten or remove the door from the opening. Even if adaptable to fully automated operation, the peripheral machinery necessary to unfasten and remove these doors from a barrel would be extremely complex and cost prohibitive.

One type of "hands-off" automatic door opening and closing apparatus for a barrel is exemplified in U.S. Pat. No. 3,861,654 issued Jan. 21, 1975 to Singleton. The door is designed for an arcuate movement between predetermined stop limits defining the door open and door closed postions. The type of structure illustrated by this patent has met with success. Nevertheless, it has been considered desirable to retain the benefits of a door which is recessed radially into the opening, as in the manual door arrangement, to prevent inadvertent sliding or falling out of the workpieces retained in the working cavity.

By way of example, electroplating small workpieces such as washers or the like requires close tolerances to be maintained between the door and aperture. If a washer were to become lodged between the edge of the door and the remainder of the container, the washer would fail to be properly electroplated or escape from the container. An increased focus on quality control could potentially lead to rejection of a large number of workpieces under such a scenario.

The present invention contemplates a new and improved door opening and closing apparatus for treatment barrels which provides an automatic "hands-off" operation along with the benefits of a close fitting recessed door arrangement.

SUMMARY OF THE INVENTION

According to the present invention, a simplified and economical automatic door assembly is provided for a treatment barrel or the like.

According to the invention, a rotatable barrel or container assembly comprises a container having opposed head ends and an aperture formed in a sidewall of the container for access to a work cavity defined therein. A door is adapted for opening and closing the aperture and means for imparting generally arcuate movement and generally radial movement to advance and retract the door is provided.

According to another aspect of the invention, the movement imparting means includes a cam slot and cam follower arrangement.

According to a further aspect of the invention, the door includes means for allowing a generally radial movement thereof while remaining operatively connected to the container.

According to yet another aspect of the invention, the door includes an end plate extending generally perpendicularly from a longitudinal portion of the door. The endplate includes an elongated cut-out adapted for sliding engagement with a trunnion operatively associated with the container.

According to a still further aspect of the invention, locking means are provided to selectively maintain the door in a locked open or closed position.

According to another aspect of the invention, a pair of push blocks are provided and adapted for engagement with the door to selectively rotate the container with the door.

The principal advantage of the subject invention is found in the simplified actuating mechanism for the door.

Another advantage of the invention resides in the adaptability and compatibility with existing automatic and manual manufacturing processes.

Yet another advantage of the invention resides in the automatic "hands-off" control of the door and resultant safety features associated therewith.

Yet another advantage of the invention is found in the reduced labor costs of manufacturing and operation of the container assembly.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in this specification and is illustrated in the accompanying drawings which form a part hereof and wherein.

DETAILED DESCRIPTION OF THE PREFERRED AND ALTERNATE EMBODIMENTS

Figure 1:
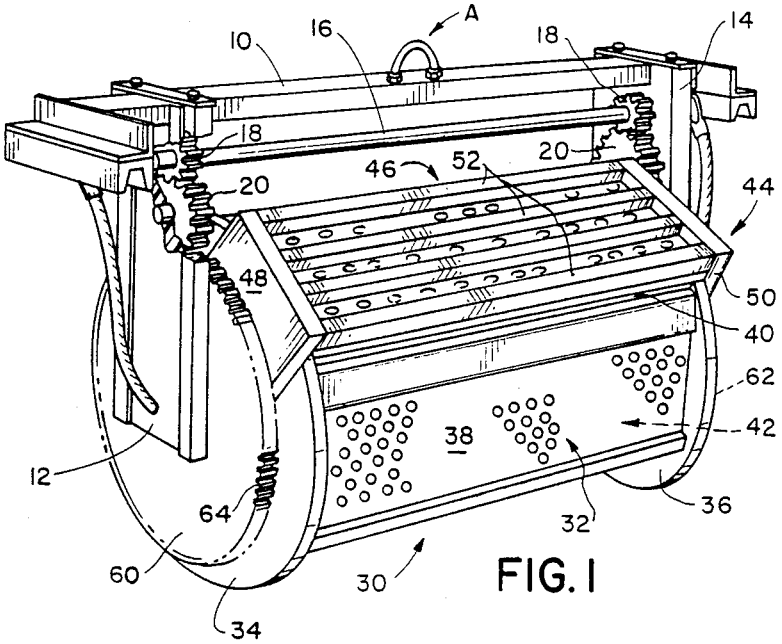
FIG. 1 is a perspective view of a rotatable container assembly and drive means and support structure associated therewith as contemplated by the subject invention.

Referring now to the drawings wherein the showings are for purposes of illustrating the preferred and alternate embodiments of the invention only and not for purposes of limiting same, the FIGURES show a support structure A that supports a container assembly B which is commonly referred to as a treatment or plating barrel assembly. The support structure A is adapted to be supported across a tank or bath of treating solution (not shown) or a series of treating tanks if so desired. The container assembly is selectively immersed in the treating tank for treatment of workpieces retained in the container assembly. Further discussion of the overall plating process is deemed unnecessary to a complete understanding of the invention.

More particularly and with reference to FIG. 1, the support structure A includes an elongated channel member 10 which is connected at its ends to downwardly extending legs 12, 14. A drive means such as an electric motor or the like (not shown) is adapted to drivingly engage drive shaft 16 and drive gear 18 disposed adjacent the ends thereof. An idler gear 20 is interposed between the drive gear 18 and a driven gear which will be described in greater detail below. As will be readily understood by one skilled in the art, the identical drive gear and idler gear arrangement arranged at the opposed end of the container assembly provides simultaneous, synchronized drive of the assembly at opposed ends. Also, alternative drive means may be employed without departing from the scope and intent of the subject invention.

A container, such as a barrel or drum 30, includes a generally cylindrical sidewall 32 extending longitudinally between spaced end members or head ends 34, 36. The sidewall may be formed as a continuous structure or, preferably, is formed from a plurality of planar members 38 arranged in a hexagonal or octogonal relationship. The term "generally cylindrical container" will be understood to include any of these defined structural relationships. The container is rotatably supported between hanger arms 12 and 14 and extends in generally parallel relation with the channel member 10. The sidewall 32 is preferably of perforated construction to allow treatment fluid to readily pass through the sidewall and, if used for electroplating, allow electrical current flow.

An aperture or opening 40 is defined in a minor portion of the sidewall 32. In the planar panel arrangement, one of the panels is removed or left out of the structure to define the aperture 40. The aperture provides ingress and egress to a work cavity or central chamber 42. The aperture is of sufficient size to easily accommodate insertion and removal of the workpieces into the work cavity 42. In fact, in the preferred embodiment the aperture comprises approximately 1/6 of the total surface area of the container, although other dimensions and ratios can be used with equal success.

Figure 3:
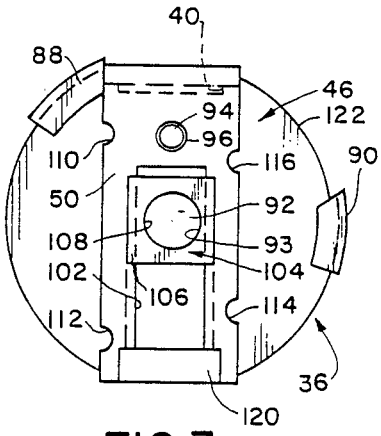
FIG. 3 is an end view of the container, particularly illustrating an end plate portion of the door in cooperating relation with a pair of push blocks.

A door 44 includes an elongated portion 46 and a pair of radially extending end plates 48, 50, as further illustrated in FIG. 3. The elongated portion 46 is designed to completely cover the aperture in a closed position while the end plates 48, 50 are disposed axially outward of the head ends 34, 36 for close fitting relation therewith. The elongated portion 46 of the door may include longitudinally extending strengthening members 52, such as steel or the like, that are encapsulated within the plastic material of the door when corrosive solutions are involved. The strenghtening members 52 enhance the rigidity of the door.

Figure 2:
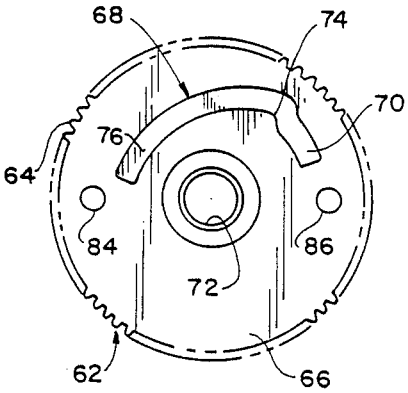
FIG. 2 is an interior end view of an interior face of a gear used in accordance with the subject invention.

With further reference to FIGS. 2 and 3, the actuating mechanism for positioning the door in an open position away from aperture 40 and a closed position substantially covering the aperture will be further described. A driven gear 60 is disposed at one end of the container 30. As indicated above, a similar driven gear 62 is operatively disposed at the other end of the container. Therefore, the numerals and description of the various elements and relationships of driven gear 62 will apply equally to driven gear 60 unless particularly noted otherwise. The gear 62 has peripherally arranged drive teeth 64 adapted for meshing engagement with peripheral teeth on idler gear 20.

An interior face 66 of the gear 62 is disposed in facing relation with the head end 36 of the container while the interior face of gear 60 is in facing relation with head end 34. The interior face 66 of the gears is clearly illustrated in FIG. 2. It includes a cam slot or groove 68 having a predetermined pattern. A first portion of the cam slot defines an arcuate length 70 at a generally constant radius from a central opening or mounting aperture 72. A crest portion 74 is interposed between the constant radius portion 70 and a radially varying portion 76. The crest portion 74 defines a path that extends radially outward from the constant radius portion while the radially varying portion defines a sloping path that spirals inwardly toward mounting aperture 72.

The drive gear 62 also includes first and second push dogs or door locks 84, 86. The precise function of the combination push dogs/door locks will be described in further detail hereinbelow.

Figures 4A, 4B, 5A, 5B:
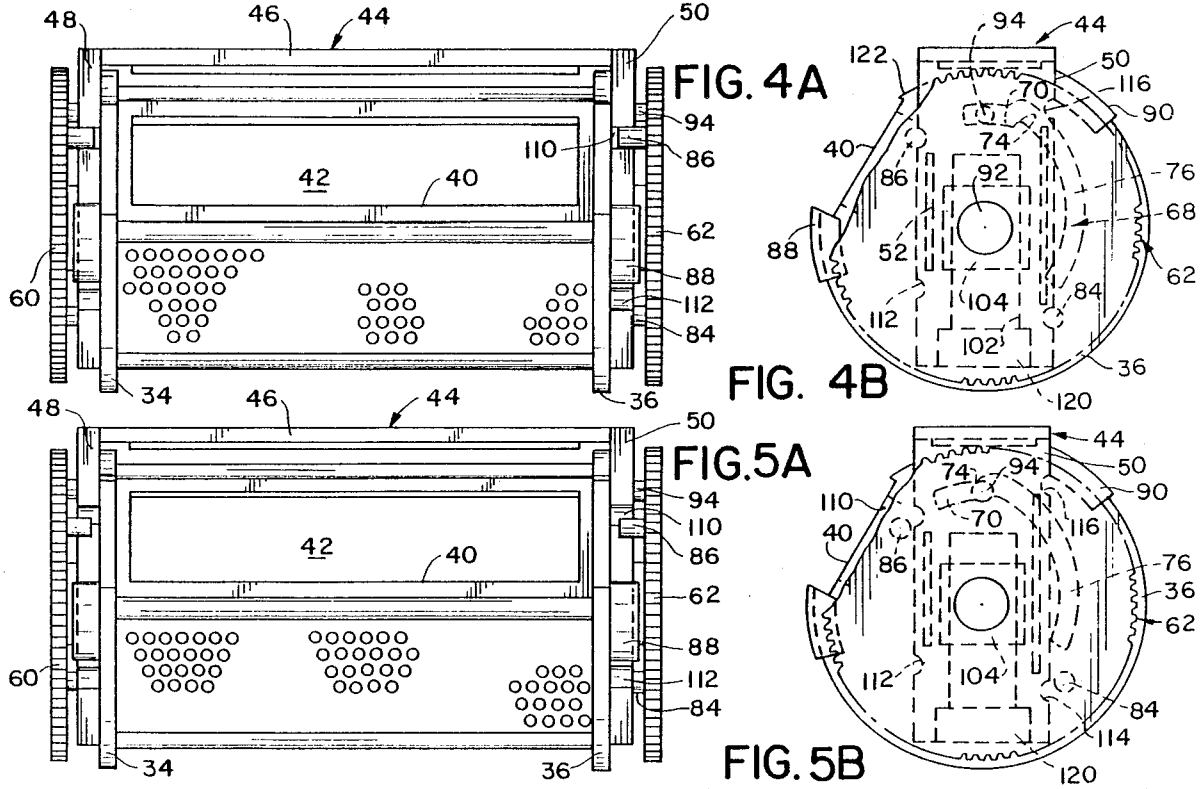
FIG. 4A is a front elevational view of the rotatable container assembly with the door in a fully open position.
FIG. 4B is a end view of the right-hand end of FIG. 4A particularly illustrating the orientation of the door and gear.
FIG. 5A is a front elevational view of the rotatable container assembly with the door in an intermediate position.
FIG 5B is a end elevational view of the right-hand end of FIG. 5A.

With particular reference to FIG. 3, a view of the cylindrical container head end 36 and a door end plate 50 is illustrated. The head end 34 and door end plate 48 disposed at the left hand portion of the container in FIG. 1 will be of identical construction and function in a similar manner as head end 36 and end plate 50 unless noted otherwise. The head end is of generally circular configuration and includes first and second push blocks 88, 90 extending axially outward therefrom. The push blocks 88, 90 are arranged adjacent a peripheral portion of the head end 36 and positioned at a preselected angular configuration adapted to accommodate the door open and door closed positions as will become more apparent below. A central hub or trunnion 92 is closely received through the head end 36 through a central aperture (not shown) and the external surface of the trunnion cooperates with a conventional bushing or bearing 93, three of which are utilized in the preferred embodiment for rotary movement of the container assembly therearound. End plate 50 is designed for abutting engagement with push block 90 in the fully open position as shown in FIG. 4B while FIG. 3 illustrates engagement with push block 88 in the closed position.

Further, a cam follower 94 extends axially outward from each end plate 48, 50 toward respective gears 60, 62. The cam follower 94 of each end plate is designed for receipt in each cam slot 68 of the inner face of drive gears 60, 62. The cooperating end plates and gears define a means for imparting generally arcuate movement and generally radial movement of the door as will be detailed below. More particularly, the cam slot 68 and cam follower 94 define a cam means for actuating movement of the door. Each cam follower includes a high-density, self lubricating member 96 peripherally arranged on the cam follower to facilitate sliding/rolling contact with the cam slot.

Further, an elongated generally rectangular aperture 102 is provided in each of the end plates and slidingly receives a slide block 104 therein. Once again, description of the right-hand end plate 50 is equally applicable to the structure of end plate 48 unless particularly noted otherwise. Preferably, the slide block 104 and elongated aperture 102 have a cooperating tongue and groove arrangement 106 adapted for ease of radial movement of the slide block relative to the end plate. The slide block 104 has a central aperture 108 with bearing 93 designed for rotative mounting on trunnion 92. The end plate 50 also includes plural door locking slots 110, 112, 114, and 116. The door locking slots are peripherally arranged on the end plate and adapted for alternately receiving the combination push dogs/door locks 84, 86 therein. Further, closing member 120 is positioned at the base of the end plate 50 at an area distally arranged from the elongated portion 46 of the door.

In mounting the door onto trunnion 92, the slide block 104 is initially positioned on the trunnion adjacent head end 36 of the container. Next, the end plate 50, with the closing member 120 removed therefrom, is radially positioned over the slide block. The cooperating tongue and groove engagement between the slide block and end plate facilitate ease of mounting. The closing member 120 is thereafter secured to the end plate to limit the radially outward movement of the door relative to the container 30 if the cam fails. Otherwise, the cam slot and cam follower limit radial outward movement of the door. The closing member also reinforces the end plate and retains alignment of the tongue/groove arrangement 106.

During operation of the door, the slide block remains stationary relative to the trunnion and rotates with the door. Nevertheless, the remainder of the end plate 50 undergoes radial inward and outward movement relative to the slide block as a result of the cam actuated movement. In this manner, the door 44 moves from a radially outer open position (see FIG. 4B) to a radially inner closed position (see FIG. 6B).

As indicated above, the push blocks 88, 90 are peripherally arranged on head 36 of the container assembly. More specifically, the circumferential arc length between the push blocks 88, 90 is approximately twice the width of door 44. Thus, in the illustrated open position of FIGS. 4A and 4B, the aperture 40 is completely exposed and end plate 50 is in abutting engagement with push block 90.

It is also noted that in the open position of the door, the head end 36 includes a radially recessed portion 122 (FIG. 3) adapted to receive the elongated portion 46 of the door therein. As will become more apparent, this assures a compact arrangement of the door with the container 30 in an open position and further prevents any interference with the drive shaft 16 or other portion of the support structure. This also provides compactness of the entire container assembly.

Turning now to FIGS. 4A and 4B, the open position of the door relative to the container and, specifically, aperture 40 will be described in detail. This is also known as the load position of the container assembly in which the aperture 40 is generally facing angularly upward for receipt of particulate workpieces therein. This position also assists an operator in viewing the loading of the container. The door 44 abuttingly engages push block 90 and is positioned at a radially outer position i.e., the slide block is closely adjacent the closing member 120 in end plate 50. Further, the combination push dog/door lock 86 is received in the door locking slot 110. Similarly, the combination push dog/-door lock 84 is received in door locking slot 114. A counterclockwise movement of the gear 60 will release the door from abutting engagement with the push block 90. More importantly, the cam follower 94 is received in the constant radius portion 70 of the cam slot. The cam slot and cam follower of the gear and door, respectively, provide for relative positioning both radially and arcuately between the container and door.

In the open position, the container is loaded with particulate workpieces through aperture 40. The aperture is sufficiently large to permit quick loading of a large number of workpieces. The specific loading mechanism forms no part of the subject invention and further discussion is deemed unnecessary to a full and complete understanding of the invention.

Figure 5C:
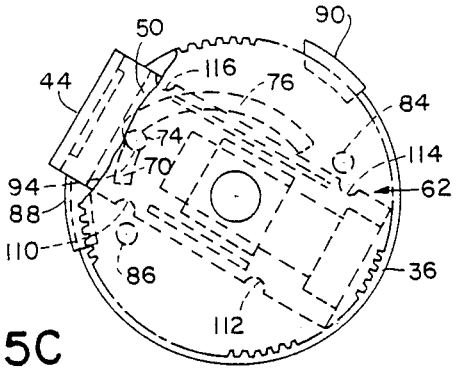
FIG. 5C is a end elevational view of the right-hand end of FIG. 5A at a further point in the door movement.

With reference to FIGS. 5A, 5B, and 5C intermediate closing positions of the door relative to the container are shown. More specifically, counterclockwise movement of the drive gear as illustrated in FIG 5B will advance the cam follower to the crest portion 74 of the cam slot. During this portion of the movement, the drive gears rotate relative to both the door and the container. At this point, further counterclockwise rotation of the gears will, in turn, rotate the door away from push block 90 and toward engagement with push block 88 due to abutting engagement between the cam follower 94 and crest portion 74. The continued counterclockwise rotation is defined by simultaneous movement of the drive gears and door and both members rotate relative to the container. Upon engagement of the door with push block 88, cam follower 94 advances radially outward over the crest portion of the cam slot. Accordingly, the door moves radially outward with respect to the container. The door is centered over the aperture 40 and will next undergo a radially inward movement.

Figures 6A, 6B, 7, 8:
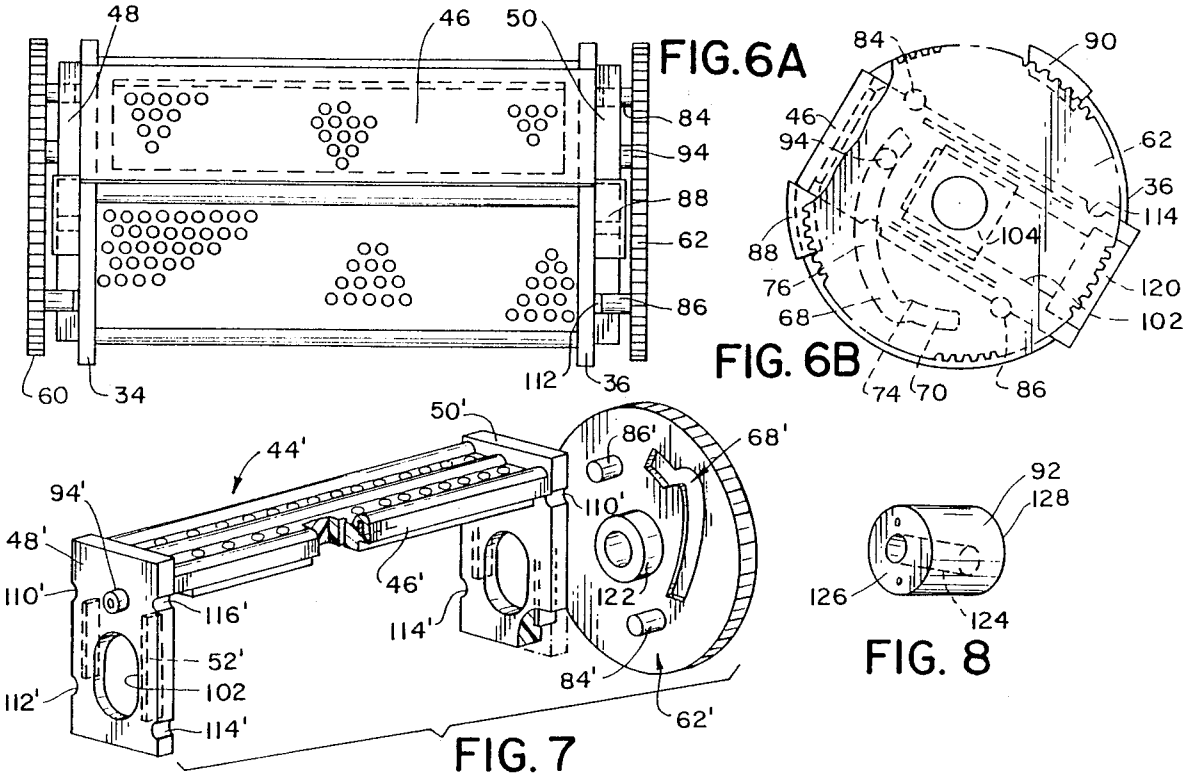
FIG. 6A is a front elevational view of the rotatable container assembly particularly showing the door in a closed position.
FIG. 6B is a end elevational view of the right-hand end portion of FIG. 6A.
FIG. 7 is a perspective view of a modified door and gear in accordance with the subject invention.
FIG. 8 is a perspective view of a trunnion member used in accordance with the subject invention.

Further counterclockwise rotation of the gears as shown moves the cam follower through the radially varying portion 76 of the cam slot. Associated with this action, is the radially inward movement of the door toward the aperture 40. Likewise, the combination push dogs/door locks 84, 86 continue to move away from door locking slots 110, 114 and toward the door locking slots 112, 116 (FIG. 5C). Once the cam follower has reached a predetermined position in the radially varying portion 76 of the cam slot away from the crest portion 74 the combination push dogs/door locks 84, 86 abuttingly engage the new pair of door locking slots 112, 116. Thus, as illustrated in FIGS. 6A and 6B the door has moved radially inward into a seated position and covers aperture 40. Any further counterclockwise movement of the gear provides simultaneous rotation of the door and the container together. This would correspond to the loaded condition of the container assembly in which it undergoes a submersion and tumbling or cascading of the workpieces retained in the work cavity.

Upon completion of the predetermined duration in the treatment tank, the container is locked in place and removed from the tank. Further rotation in a counterclockwise direction orients the container essentially as shown in FIG. 6B. The drive gears are now rotated in a clockwise manner as shown until the door opens relative to the aperture in a reverse manner from that described above. The door moves radially outward as the cam follower 94 proceeds through the radially varying portion 76 of the cam slot toward the crest portion. Once the cam follower reaches the crest portion 74 of the cam slot, the gear and door rotate together away from push block 88 and toward push block 90. Upon abutting engagement with the push block 90, the cam follower passes over the crest portion and into the constant radius portion 70 of the cam slot. Accordingly, during this procedure the combination push dogs/door locks 84, 86 have also moved from engagement with locking slots 112, 116 to the locking slots 110, 114. At this point, the aperture is completely uncovered and further clockwise rotation, as shown, of the cylindrical container 30 provides for emptying the contents from the work cavity. That is, the aperture is rotated in a clockwise direction until it faces downwardly. Once the contents are emptied, the clockwise rotation continues until the aperture is positioned in an angularly upward position for the next loading of workpieces (FIG. 4A).

As is apparent from the above description, an operator of the plating container 30 can be located in a "hands-off" position where he is safely clear of the loading and unloading operation of the barrel. There is no requirement for any manual contact with the door and the radially inward movement of the door with respect to the aperture eliminates any gaps therebetween and prevents any particulate workpieces from falling out. This arrangement also eliminates any need for springs or clamping arrangements to retain the door in a closed position with the aperture. The motor is only required to be of the reversing type and no special controls are required. The complete opening and closing action of the door is governed by the rotation of the gears and the cam follower tracking in the cam slot along with the door and push block engagement as well as the combination push dog/door lock and end bracket engagement. Further, only the weight of the door is loaded on the cam follower and cam slot.

Referring now to a modified door as illustrated in FIG. 7, and for ease of illustration, like elements are indentified by like numerals with a primed (') suffix and new elements are defined by new numerals. The modified door 44' includes an elongated portion 46' that is reinforced through use of encapsulated strengthening members 52' that extend along the longitudinal length of the door. Opposed end plates 48', 50' are disposed in a generally perpendicular relation with respect to the elongated portion 46'. A cam follower 94' extends axially outward from each of the end plates 48', 50'. In much the same manner as described above, the cam follower 94' of each end plate is designed for cooperating relation with an inwardly facing cam slot on an interior face of opposed driven gears, only one of which is shown for ease of illustration. In the preferred embodiment of FIGS. 1–6, an elongated aperture received a slide block therein for permitting radial movement of the door with respect to trunnion 92. The preferred arrangement is designated for extreme wear conditions so that the wear resulting from the radially inward and outward movement of the door is dispersed over the tongue and groove arrangement of the slide block and end plate.

In the modified arrangement of FIG. 7, an elongated aperture 102' is defined in each of the end plates and adopts a generally elliptical configuration or any conforming slot with rounded corners. The minor diameter of the ellipse generally conforms to the outer diameter of raised portion 122 of the drive gear 62'. In this manner, wear between the relatively moving parts is not distributed over as great a surface area. Nonetheless, this arrangement is more than satisfactory for most industrial applications and significantly decreases the complexity as well as machining and assembly costs. The end plates still utilize plural door locking slots 110', 112', 114', and 116' and encapsulated steel reinforcement 52'. In all other respects, the modified door arrangement of FIG. 7 functions in approximately the same manner as that described with the preferred embodiment of FIGS. 1–6.

The trunnion 92 is particularly illustrated in FIG. 8 and, as described above, is fixedly mounted to a support hanger arm 12 or 14. As illustrated, the trunnion has a generally cylindrical configuration with an aperture extending generally longitudinally therethrough. The aperture 124 is centrally positioned at a first or outer end 126 but is eccentrically disposed at a second or inner face 128. The trunnion aperture is designed to receive a dangler therethrough. The dangler will thereby maintain a generally downwardly angled configuration and not migrate appreciably upward with workpieces during rotation of the container, notwithstanding virtually constant impinging contact with the workpieces.

As is well known in the art, when used for electroplating the danglers are provided to supply the high current or throwing power necessary to effect plating of the workpieces. An electric current induced through the danglers charges the workpieces through contact therewith. As the container is rotated, the workpieces to be plated are continuously exposed to a relatively uniform high current field by repeated rotation and exposure to one of the danglers or by conduction through other workpieces. The presence of the electric current causes migration of the plating ions to the workpieces. If the danglers are not required, a blind trunion may be utilized.

Figure 9:
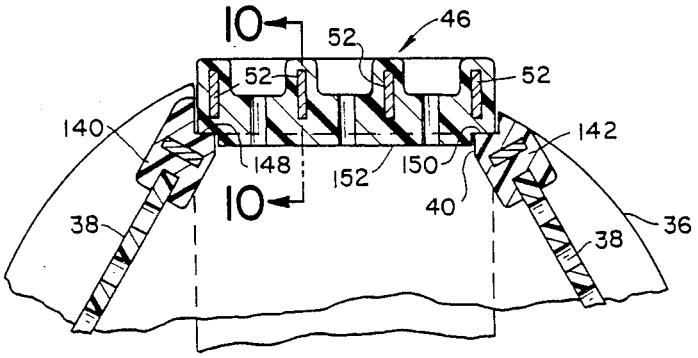
FIG. 9 is a cross-sectional view along the lines 9—9 of FIG. 10.
Figure 10:
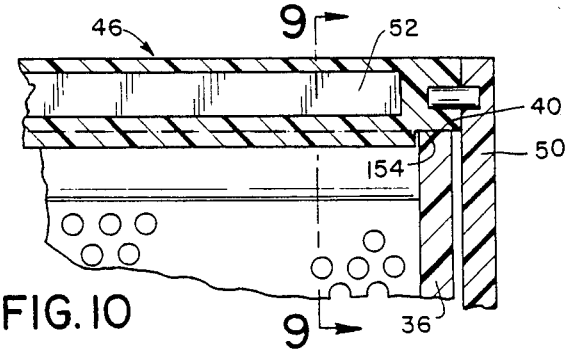
FIG. 10 is a cross-sectional view along the lines 10—10 of FIG. 9; and, FIGS. 11-16 generally illustrate the interacting forces in maintaining the door in an open or closed position.

Turning now to FIGS. 9 and 10, the advantageous arrangement of the door with respect to the aperture will be described in greater detail. The elongated portion 46 of the door is of notched design so that it fully seats within the aperture 40. As shown in FIG. 9, a pair of axially extending door ribs 140, 142 receive two perforated panels 144, 146 defining a portion of the container sidewall. The ribs each define a recessed step portion 148, 150 that, in turn, matingly receives a stepped lower surface 152 of the door. In a fully closed position, the step portions 148, 150 abuttingly support the door so that particulate workpieces in the container are retained therein.

Similarly, and with reference to FiG. 10, the door elongated portion 46 also includes an axial step surface 154 that closely accommodates a head end. The stepped, mating configuration facilitates retention of the workpieces in the work cavity.

Figure 11:
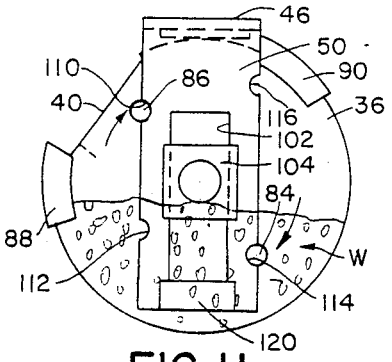
Figure 12:
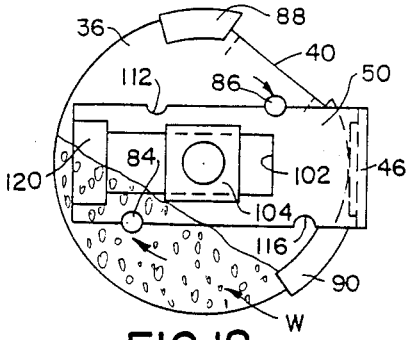
Figure 13:
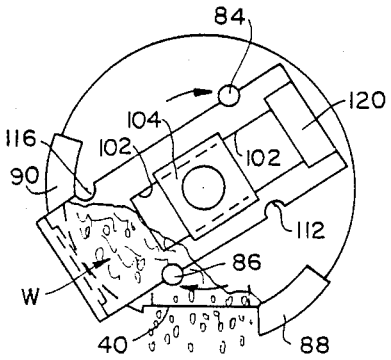

Yet another advantageous feature is provided by the subject invention. Referring now to FIGS. 11–13, the dumping sequence of the container is shown. In FIG. 11, the container has completed the treatment process of the workpieces W and the aperture 40 is positioned in an angular upward loading position. The door opening process is completed and further clockwise rotation of the container as shown orients the aperture in a downward position. As particularly detailed in FIG. 12, the workpieces have a tendency to "climb" along the left-hand portion of the work cavity as rotation of the container continues. The workpieces tend to exert a counterclockwise torque or rotation on the container which is opposed to the clockwise rotation of the gear. Thus, the combination push dogs/door locks tightly engage the door locking slots 110, 114 and the end plate abuts push block 90.

Figure 14:
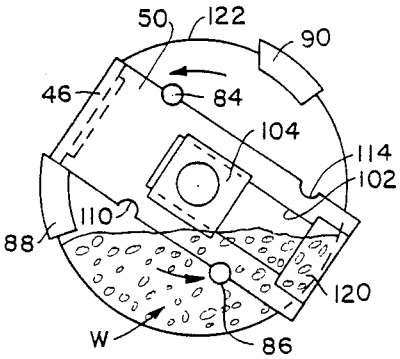
Figure 15:
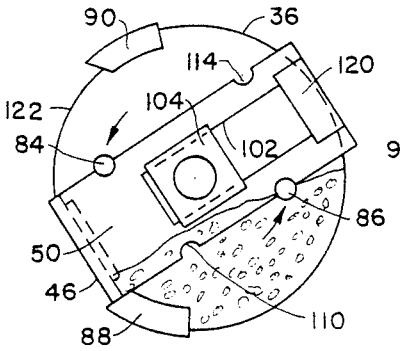
Figure 16:
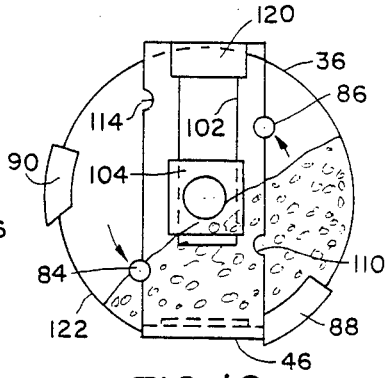

The sequence of FIGS. 14–16 depicts the tumbling action of the workpieces once the container has been loaded, the door closed over the aperture, and the container rotated in a counterclockwise direction as shown for treating in a treatment tank. During the counterclockwise rotation, the workpieces migrate up to right hand side of the work cavity thereby imposing a clockwise torque or rotation on the container. The shift in weight to an uneven distribution eccentrically positions the centroid of the workpieces toward the right hand portion of the container in relation to the axis of rotation defined through the trunnion. The combination push dogs/locking pins now tightly engage the door locking slots 112, 116 and the end plate abuts push block 88. Thus, as is apparent, the open position and the closed position of the door is enhanced by the force and torque exerted by the workpieces.

The invention has been described with reference to the preferred and modified embodiments. Obviously modifications and alterations will occur to others upon a reading and understanding of this specification. It is intended to include all such modifications and alterations insofar as they come within the scope of the appended claims or the equivalents thereof.

Having thus described the invention, it is now claimed:

1. A rotatable container assembly for use in the surface treatment of particulate workpieces selectively enclosed therein, said container assembly comprising:

a container having opposed head ends held in spaced relation by a side member and defining a work cavity therein;

an aperture formed in a minor portion of said side member for ingress and egress to said work cavity;

a door for opening and closing said aperture, said door being attached to the container in both open and closed positions; and, means for imparting generally radial movement to advance and retract said door between said open position and said closed position relative to said aperture.

* * * * *